US006653539B2

(12) United States Patent
Nagahara

(10) Patent No.: US 6,653,539 B2
(45) Date of Patent: Nov. 25, 2003

(54) WEAR PROTECTION FOR MUSICAL WIND INSTRUMENTS

(76) Inventor: Kanichi Nagahara, 32 Wild Rose Dr., Andover, MA (US) 01810-4620

( * ) Notice: Subject to any disclaimer, the term of this patent is extended or adjusted under 35 U.S.C. 154(b) by 0 days.

(21) Appl. No.: 09/919,154

(22) Filed: Jul. 31, 2001

(65) Prior Publication Data

US 2003/0024372 A1 Feb. 6, 2003

(51) Int. Cl.[7] ..... G10F 1/02

(52) U.S. Cl. ..... 84/380 R; 84/384; 84/385 R; 84/385 A

(58) Field of Search ..... 84/380 R, 384, 84/385 R, 385 A

(56) References Cited

U.S. PATENT DOCUMENTS 3,421,398 A * 1/1969 Whiteside et al. ..... 384/202
3,685,388 A * 8/1972 Young ..... 84/384
4,701,978 A 10/1987 Selmer
4,909,123 A 3/1990 Butenschon, III
4,957,029 A 9/1990 Kahonen
5,299,486 A * 4/1994 Weingrill ..... 84/380 R
5,524,520 A 6/1996 Brogger
5,898,116 A 4/1999 Lin
6,034,312 A 3/2000 Lubell et al.
D427,228 S 6/2000 Light
6,124,538 A 9/2000 Landell

* cited by examiner

*Primary Examiner*—Shih-Yung Hsieh

(57) ABSTRACT

A modification to musical wind instruments is provided which utilizes placement of interface inserts between sections of the instrument which come into contact with each other during normal operation of the instrument thus eliminating wear on the sections of the instrument. In a preferred embodiment, annular interface inserts are fitted into the grooves made in the sections of the instrument. This arrangement conceals the annular interface inserts, preserves the acoustic qualities of the instrument, and is easy to apply to already existing instruments.

2 Claims, 5 Drawing Sheets

WEAR PROTECTION FOR MUSICAL WIND INSTRUMENTS

FIELD OF THE INVENTION

The present invention relates to musical wind instruments (also called woodwind instruments) and especially to wind instruments that are made out materials that are subject to wear such as metals and metal alloys.

A typical mechanism of a wind instrument consists of a number of "keys" designed to cover openings or "toneholes" in the body of the instrument, thereby increasing or decreasing the effective length of the tube, changing the pitch of the note sounded. Each unit of the mechanism typically consists of one or more keys, and a certain length of mechanism tubing. Through this mechanism tubing a shaft is passed, itself held in place at its ends by the posts. The shaft may or may not rotate freely, depending on the section of the instrument where it is used, and the maker's preferences. The shaft serves the function of orienting the keys over the toneholes, and also provides an axle around which the keys may rotate while opening or closing the toneholes.

The keys of the instrument, being moving sections that rub against each other, are subject to wear. The consequence of this wear is lateral play, which may prevent the key from covering the tonehole properly. Also, excessive noise may result as loose keys, no longer perfectly fitted to the shaft, strike each other as the instrument is played.

The rate and amount of wear can be influenced by a number of factors including the grade of materials used in construction, the body chemistry of the player, and the external environment. However, by far the most common cause is friction between the keys. Musical wind instrument mechanisms are typically made from silver or gold, and as these metals are relatively soft, constant rubbing of adjacent keys leads to rapid wear.

The usual solution to this wear problem that exists in the field today is "swaging", a process that lengthens the mechanism tube by squeezing its outside surface with circular swaging pliers against a supporting shaft inside the tube. This process can damage the outer finish of the tube and repeated swaging can diminish the outer diameter of the mechanism to the point where the change becomes visible. The swaging is above all, only a temporary solution, in effect treating the symptom rather than the cause. Further use of the instrument will inevitably lead to greater wear of the keys despite repeated swaging.

To solve this problem there is a need for a modification of the wind instrument mechanism that would eliminate or substantially reduce the occurrence of friction between adjacent keys.

SUMMARY OF THE INVENTION

This invention satisfies the above needs. A novel modification to musical wind instrument mechanism is provided.

The present invention eliminates wear between keys by the use of interface inserts within the mechanism of the musical wind instrument at the areas where different sections of the mechanism come into contact with each other during normal operation of the instrument. The interface inserts could have varying shapes and sizes depending on their location within the instrument. Significantly, the disclosed introduction of the interface inserts does not affect the quality of the sound or ease of operation of the instrument. Furthermore, the disclosed modification reduces the noise made by the keys striking each other as the instrument is being played.

BRIEF DESCRIPTION OF DRAWINGS

These and other features, aspects and advantages of the present invention will become better understood with reference to the following description, appended claims, and accompanying drawings where:

DESCRIPTION OF THE INVENTION

This invention represents a modification of a musical wind instrument that prevents wear from friction between different sections of the instrument.

Figure 1:
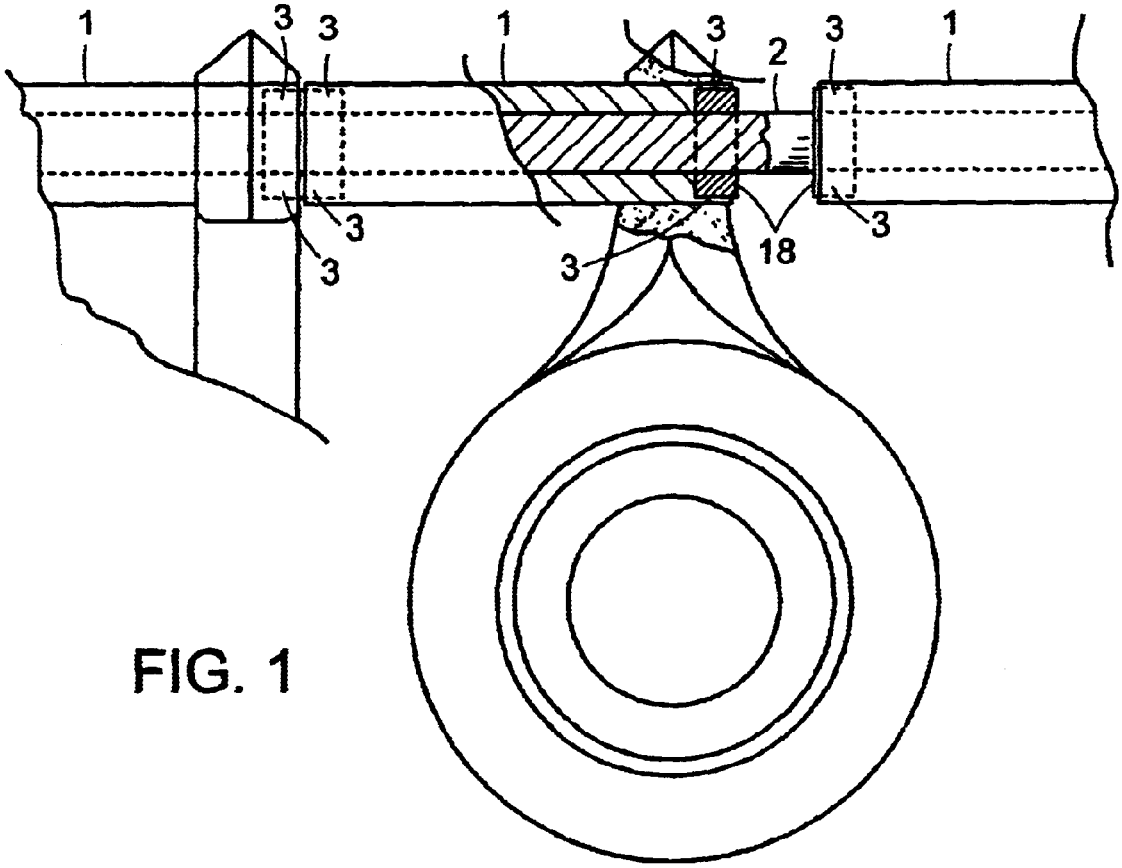
FIG. 1 is a lateral cross-sectional view of a portion of an instrument showing interface inserts at the areas of contact between three tubular tubing sections ("keys")
Figure 2:
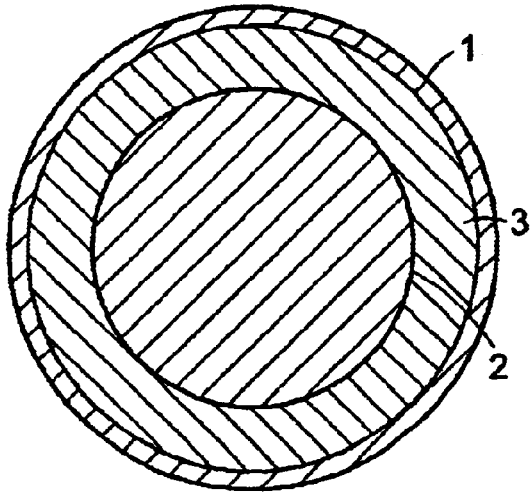
FIG. 2 is a medial cross-sectional view of the embodiment shown in FIG. 1, showing a tubular tubing section with an annular interface insert.
Figure 4:
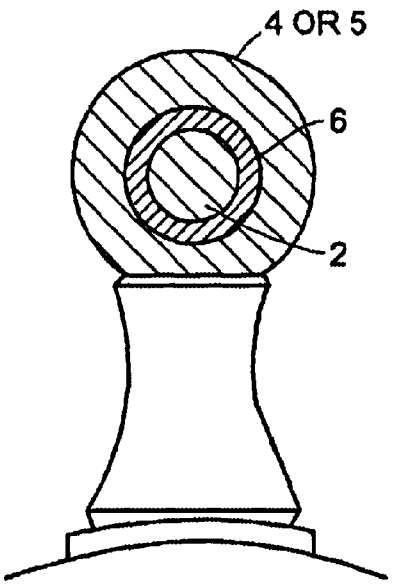
FIG. 4 is a medial cross-sectional view of an embodiment shown in FIG. 3, showing a post with a tubular interface insert between the post and a shaft.
Figure 3:
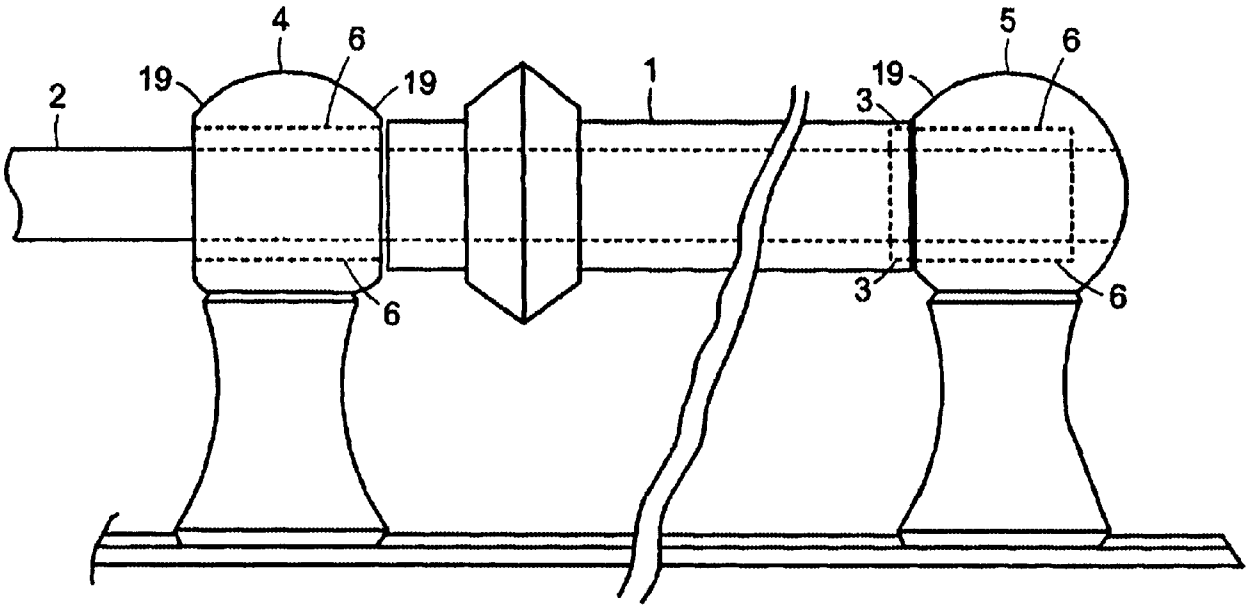
FIG. 3 is a lateral cross-sectional view of a portion of an instrument showing tubular interface inserts at the areas of contact between posts and a shaft as well as annular interface insert placed on a tubular tubing section.
Figure 6:
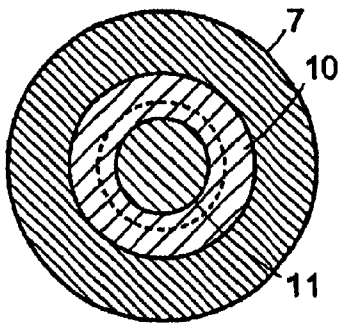
FIG. 6 is a medial cross-sectional view of an embodiment shown in FIG. 5, showing a roller with a tubular roller interface insert between the roller housing and the roller bolt.
Figure 5:
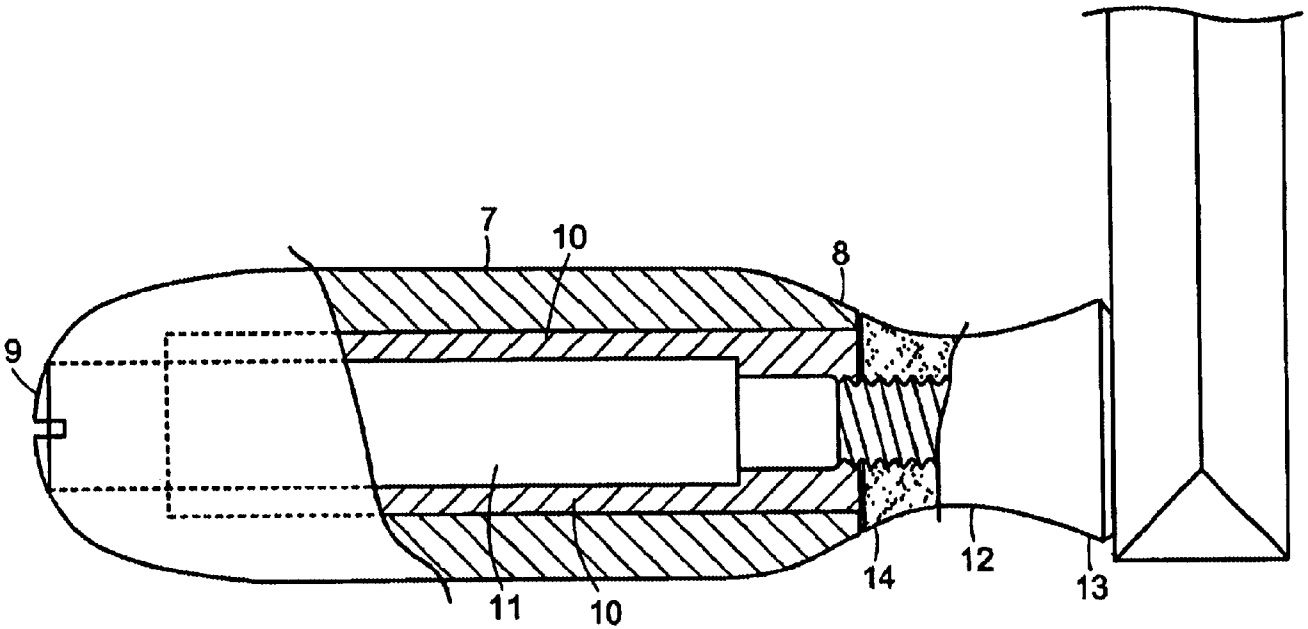
FIG. 5 is lateral cross-sectional view of a roller with a tubular roller interface insert between the roller housing and a roller bolt.
Figure 7:
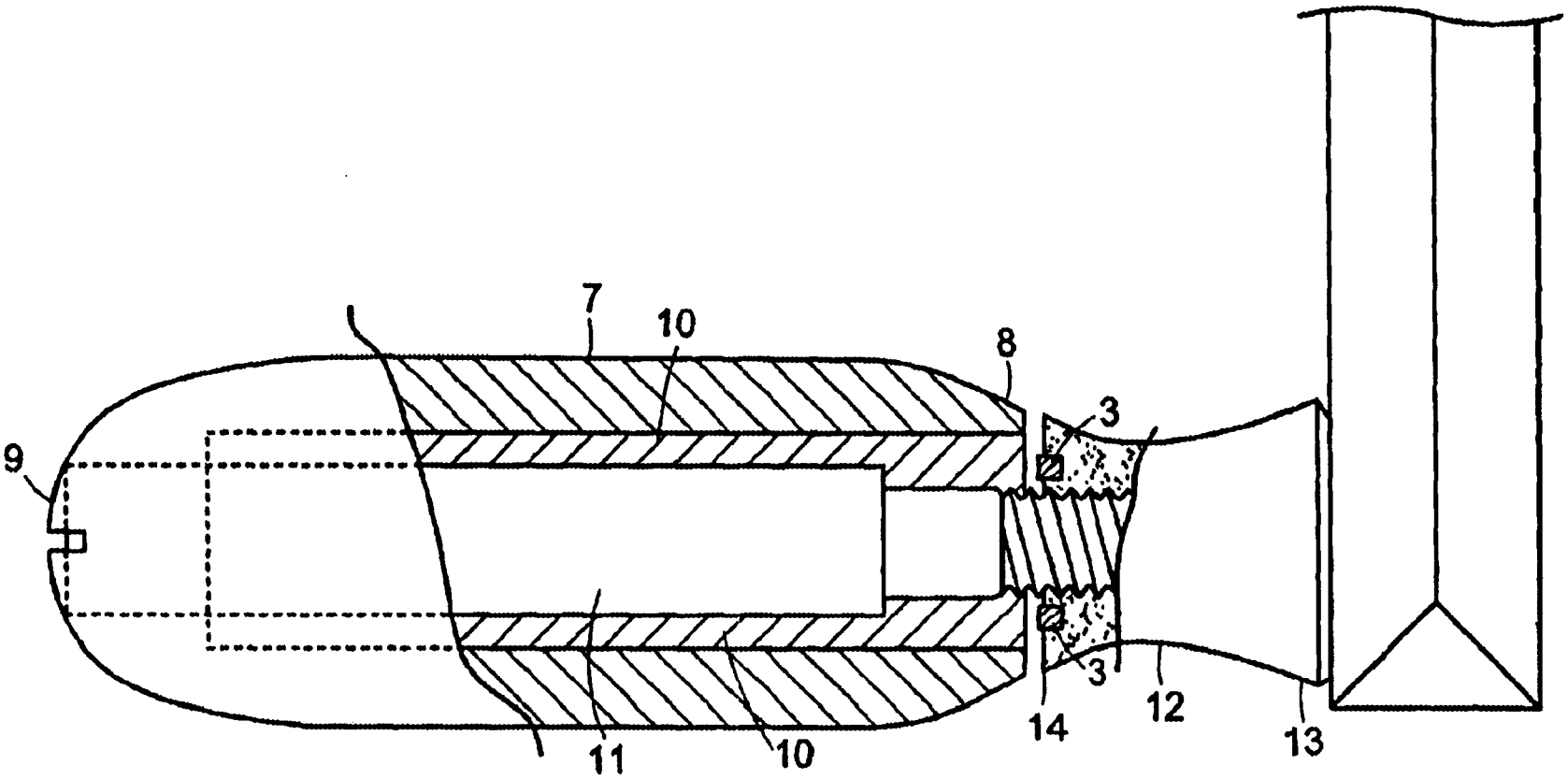
FIG. 7 is a lateral cross-sectional view on an embodiment where the roller receiver has an annular interface insert.
Figure 8:
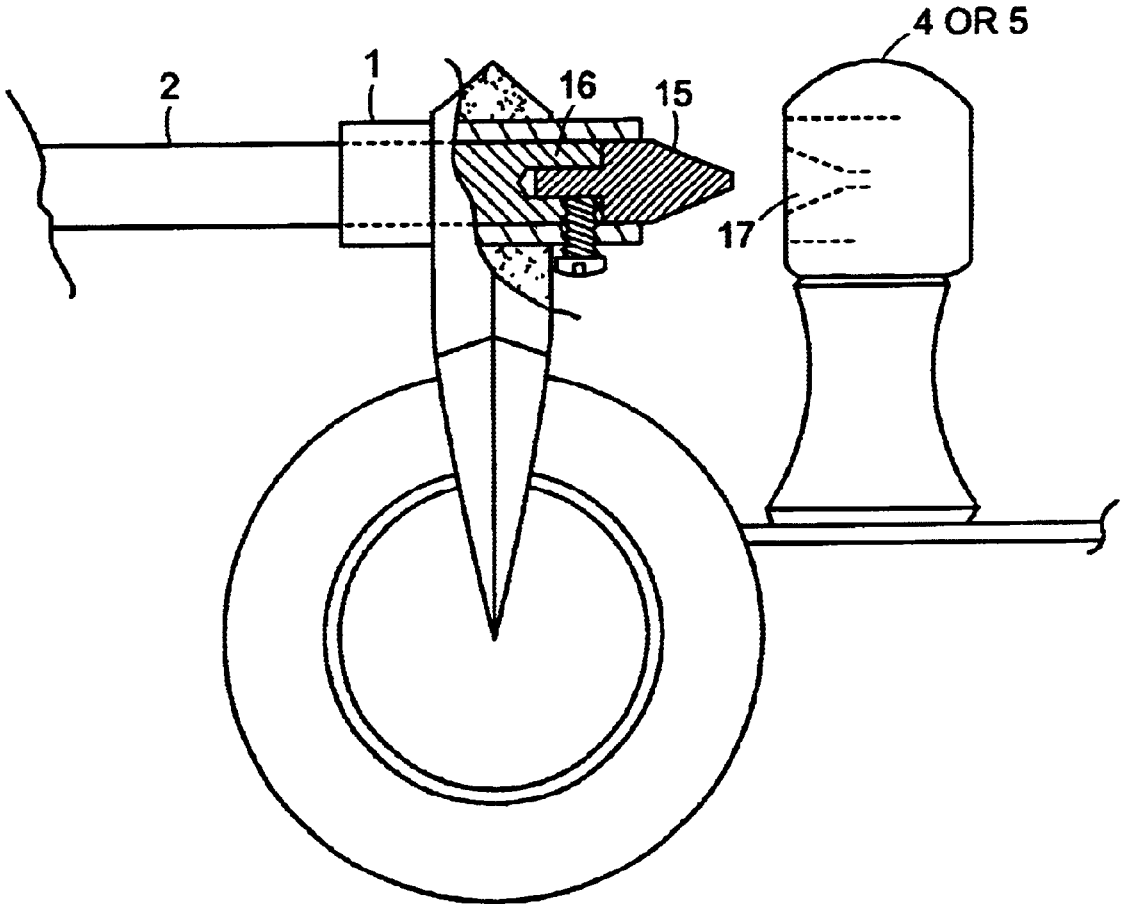
FIG. 8 is lateral cross-sectional view of a cone shaped bearing interface insert positioned between a mating end of a shaft and a post.

The basic component of the claimed invention is an interface insert such as an annular interface insert 3 shown in FIGS. 1, 2, and 7, which could be also modified to be a tubular interface insert 6 shown in FIGS. 3 and 4, a tubular roller interface insert 10 shown in FIGS. 5–7, and a cone shaped bearing interface insert 15 shown in FIG. 8. The composition of the interface insert could vary as long as it is made out of a solid wear-resistant non-metallic material such as plastic or ceramic.

The concept of the invention is to position interface inserts between all sections of the instrument mechanism which come into contact with each other during normal operation of the instrument. To illustrate this concept, FIG. 1 shows a section of the mechanism where tubular tubing sections ("keys") 1 are positioned next to each other with a shaft 2 passing through them. During operation of the instrument, rotation of the tubular tubing sections 1 around the axis of the shaft 2 causes friction between adjacent end points 18 of the tubular tubing sections 1. To prevent that, an annular interface insert 3 is fitted into the grooves at the end points 18 of the tubular tubing sections 1. Since the annular interface inserts 3 protrude slightly beyond the edge of the end points 18 of the tubular tubing sections 1, the friction between the end points 18 of the tubular tubing sections 1 is relieved. Now the contact is made between annular interface inserts 3 positioned at the adjacent end points 18 of the adjacent tubular tubing sections 1 as shown in FIG. 1. The annular interface inserts 3 could also provide protection from contact between end points 18 of tubular tubing sections 1 and posts such as support post 4 or end post 5 as shown in FIG. 3.

In an alternative embodiment, only one of the adjacent end points 18 of the adjacent tubular tubing sections 1 would have an annular interface insert 3. Here the contact would be between the annular interface insert 3 and the end point 18 of the tubular tubing section 1 which lacks an interface insert. As could be readily understood, such arrangement would also reduce wear between tubular tubing sections 1 since it eliminates direct contact between end points 18 of the adjacent tubular tubing sections 1.

Similarly, the interface insert could be placed in other areas of the instrument were sections come into contact with each other. As shown in FIG. 3, a tubular interface insert 6 is placed within support posts 4 or end posts 5 to prevent direct contact between posts and the shaft 2. The tubular interface inserts 6 protects from direct contact between posts and shaft 2. The tubular interface insert 6 could also protrude slightly beyond the end points 19 of the posts so as to prevent direct contact between posts and tubular tubing sections 1.

Another section that is common to musical wind instruments is a roller, which is normally made up of a roller housing 7, a roller bolt 11, and a roller receiver 12 as depicted in FIG. 5 with the only exception in that the tubular roller interface insert 10 is absent in prior art thus allowing for direct contact between roller housing 7 and roller bolt 11. The advantage of modification of having a tubular roller interface insert 10 positioned between roller housing 7 and the roller bolt 11 as depicted in FIGS. 5 and 6 is elimination of friction between the roller housing 7 and the roller bolt 11. The roller housing 7 also has a first end 8 and a second end 9 as shown in FIG. 5. The tubular roller interface insert 10 could be modified to protrude slightly beyond the first end 8 of the roller housing 7 thus preventing direct contact between the first end 8 of the roller housing 7 and the second end 14 of the roller receiver 12. Additionally, the roller receiver 12 could have its own annular interface insert 3 positioned at its second end 14 as shown in FIG. 7. This arrangement also prevents direct contact between the second end 14 of the roller receiver 12 and the first end 8 of the roller housing 7.

Many musical wind instruments have a mechanism shown in FIG. 8 where the shaft 2 has a mating end 16 which is in turn mated to the cone shaped bearing 15 and where the cone shaped bearing 15 could be fitted within the axial conical cutout 17 of the post 4 or 5. The disclosed modification consists of using wear resistant material of the disclosed interface inserts for the make up of the cone shaped bearing 15. This in effect creating a cone shaped bearing interface insert 15 which prevents direct contact between the shaft 2 and the post 4 or 5 as depicted in FIG. 8.

DESCRIPTION OF THE PREFERRED EMBODIMENT

In a preferred embodiment, every location within the instrument that has points of contact between separate sections of the instrument is modified to incorporate interface inserts that will prevent direct contact between sections as they move against each other during normal operation of the instrument.

In addition, it is preferred to have interface inserts located on both adjacent ends of the adjacent sections of the instrument so as to have a point of contact where each interface insert touches another interface insert. An example of that could be seen in FIG. 1 where each tubing section 1 has annular interface inserts 3 on each end point 18. As the tubular tubing sections 1 move around the axis of the shaft 2, the end points 18 never come into direct contact with each other. Furthermore, there is no rubbing of a bare end point 18 against an annular interface insert 3 of an adjacent end point 18 of another tubular section 1. By having only interface insert to interface insert contact, there is a lesser degree of wear on the instrument. This is unlike a configuration where there is direct rubbing between bare section of an instrument and an interface insert as would be the case in FIG. 1 if among adjacent end points 18 only one end point 18 had an annular interface insert 3.

In a preferred embodiment, whenever possible, the interface inserts are annular interface inserts 3 or tubular interface inserts 6 fitted into grooves in the instrument. Such arrangement could be seen in FIGS. 1–7. Such concealment of the interface inserts allows for preservation of the accustomed to appearance of the instruments. Additionally, this allows for easy and quick modification of existing instruments by creating groves and inserting annular interface inserts into grooves. Thus a musician would not need to buy a new instrument and can simply modify his or her instrument to accept interface inserts.

Whenever interface inserts protrude beyond a normal end point of a section of an instrument, such protrusion is minimal as could be seen in FIG. 1. This has a number of advantages. One of them is preservation of the original appearance of the instrument. Another is preservation of the acoustic qualities of the instrument.

What is claimed is:

1. A wear protection device for a musical wind instrument comprising:

at least one grooved section at an engaging end in communication with an adjoining section of the musical instrument during normal operation of the musical instrument; and an interface insert positioned in the grooved section, wherein an exposed end of the interface insert extends beyond the engaging end of the grooved section of a musical instrument, whereby the interface insert prevents direct contact between the mating end of the grooved section of the musical instrument and the adjoining section of the musical instrument wherein a tubular roller interface insert is positioned between a roller housing and a roller bolt wherein the roller bolt and the tubular interface insert are housed within the roller housing and wherein the external diameter of the tubular roller interface insert is substantially equal to the internal diameter of the roller housing while the internal diameter of the tubular roller interface insert is substantially equal to the external diameter of the roller bolt.

2. A wear protection device for a musical wind instrument comprising at least one post, the post having a bore opening, and having a shaft passing through the bore opening, wherein a tubular interface insert is affixed to a surface of the bore opening, whereby the tubular interface insert prevents direct contact between the shaft and the post, wherein a tubular roller interface insert is positioned between a roller housing and a roller bolt wherein the roller bolt and the tubular roller interface insert are housed within the roller housing and wherein the external diameter of the tubular roller interface insert is substantially equal to the internal diameter of the roller housing while the internal diameter of the tubular roller interface insert is substantially equal to the external diameter of the roller bolt.

* * * * *